US010935290B2

(12) United States Patent
Creason

(10) Patent No.: US 10,935,290 B2
(45) Date of Patent: Mar. 2, 2021

(54) PRESSURE SPIKE PREVENTION IN HEAT PUMP SYSTEMS

(71) Applicant: Rheem Manufacturing Company, Atlanta, GA (US)

(72) Inventor: Mark O. Creason, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 85 days.

(21) Appl. No.: 16/287,944

(22) Filed: Feb. 27, 2019

(65) Prior Publication Data

US 2020/0271364 A1 Aug. 27, 2020

(51) Int. Cl.
*F25B 47/02* (2006.01)
*F25B 49/00* (2006.01)

(52) U.S. Cl.
CPC ..... *F25B 47/025* (2013.01); *F25B 49/005* (2013.01); *F25B 2313/005* (2013.01); *F25B 2313/0292* (2013.01); *F25B 2313/02731* (2013.01); *F25B 2400/16* (2013.01); *F25B 2400/19* (2013.01); *F25B 2500/27* (2013.01); *F25B 2600/2519* (2013.01)

(58) Field of Classification Search
CPC ..... F25B 47/025
See application file for complete search history.

(56) References Cited

U.S. PATENT DOCUMENTS 4,030,312 A * 6/1977 Wallin ..... F24F 5/0046 62/235.1
5,117,647 A * 6/1992 Valbjorn ..... F25B 41/062 251/30.05
9,874,365 B2 * 1/2018 Fujita ..... F24F 11/0008
2003/0164001 A1 * 9/2003 Vouzelaud ..... B60H 1/00885 62/244
2011/0100035 A1 * 5/2011 Taras ..... F24F 3/153 62/90
2012/0023982 A1 * 2/2012 Berson ..... F24F 5/0046 62/115
2012/0167602 A1 * 7/2012 Taras ..... F25B 49/02 62/115
2012/0247142 A1 * 10/2012 Hawkins ..... F25B 30/02 62/324.4
2017/0059219 A1 * 3/2017 Goel ..... F25B 43/006
2017/0102174 A1 * 4/2017 Chen ..... F25B 41/04
2017/0102175 A1 * 4/2017 Chen ..... F25B 41/04

* cited by examiner

*Primary Examiner* — Henry T Crenshaw
(74) *Attorney, Agent, or Firm* — Troutman Pepper Hamilton Sanders LLP

(57) ABSTRACT

A pressure spike prevention assembly for use in a heat pump system includes a thermostatic expansion valve that includes a first port and a second port. The first port is designed to be fluidly coupled to an indoor coil, and the second port is designed to be coupled to an outdoor coil. The pressure spike prevention assembly further includes a multi-way valve that includes an inlet port, an output port, and a liquid line port. The inlet port is fluidly coupled to the first port. The output port is fluidly in communication with the second port. The liquid line port is configured to be fluidly coupled to a charge compensator of the heat pump system via a liquid line of the heat pump system.

20 Claims, 5 Drawing Sheets

PRESSURE SPIKE PREVENTION IN HEAT PUMP SYSTEMS

TECHNICAL FIELD

The present disclosure relates generally to heat pump systems, and more particularly to the prevention of pressure spikes related to refrigerant from a charge compensator.

BACKGROUND

Some heat pump systems include low volume coils, such as microchannel coils, as indoor and outdoor coils. For example, microchannel coils can provide improved thermal performance and reduced refrigerant charge. Microchannel coils have relatively smaller volume that result in lower condenser refrigerant charge. However, in heat pump systems, such as packaged heat pump units, that utilize microchannel coils and a single, bidirectional thermal expansion device, a spike in the pressure of the refrigerant flow system can occur during the defrost cycle. In particular, the introduction of liquid refrigerant from the charge compensator to the refrigerant line downstream of the thermal expansion device (i.e., between the thermal expansion device and the indoor coil) can result in the thermal expansion device closing to compensate for a reduction of superheat in the indoor coil. The closing of the thermal expansion device can cause the pressure in the discharge line of the system to become excessively high, which can result in the heat pump system shutting down. Thus, a solution that prevents pressure spikes during defrost mode operations of heat pump systems that include low volume coils (e.g., microchannel coils) and a single bidirectional thermal expansion valve is desirable.

SUMMARY

The present disclosure relates generally to heat pump systems, and more particularly to the prevention of pressure spikes related to refrigerant from a charge compensator. In some example embodiments, a pressure spike prevention assembly for use in a heat pump system includes a thermostatic expansion valve that includes a first port and a second port. The first port is designed to be fluidly coupled to an indoor coil, and the second port is designed to be coupled to an outdoor coil. The pressure spike prevention assembly further includes a multi-way valve that includes an inlet port, an output port, and a liquid line port. The inlet port is fluidly coupled to the first port. The output port is fluidly in communication with the second port. The liquid line port is configured to be fluidly coupled to a charge compensator of the heat pump system via a liquid line of the heat pump system.

In another example embodiment, a heat pump system includes a charge compensator and a thermostatic expansion valve that includes a first port and a second port. The heat pump system further includes a multi-way valve that includes an inlet port, an output port, and a liquid line port. The inlet port is fluidly coupled to the first port. The output port is fluidly in communication with the second port. The liquid line port is fluidly coupled to the charge compensator via a liquid line of the heat pump system.

In another example embodiment, a method of operating a heat pump system that includes a pressure spike prevention assembly includes controlling, by a control unit, a multi-way valve to provide a first flow path for a refrigerant to flow from an indoor coil to a charge compensator through an inlet port of the multi-way valve and a liquid line port of the multi-way valve during a heating mode operation of the heat pump system. The method further includes controlling, by the control unit, the multi-way valve to provide a second flow path for the refrigerant to flow from the charge compensator to a thermostatic expansion valve through the liquid line port of the multi-way valve and an outlet port of the multi-way valve during a cooling or defrost mode operation of the heat pump system.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
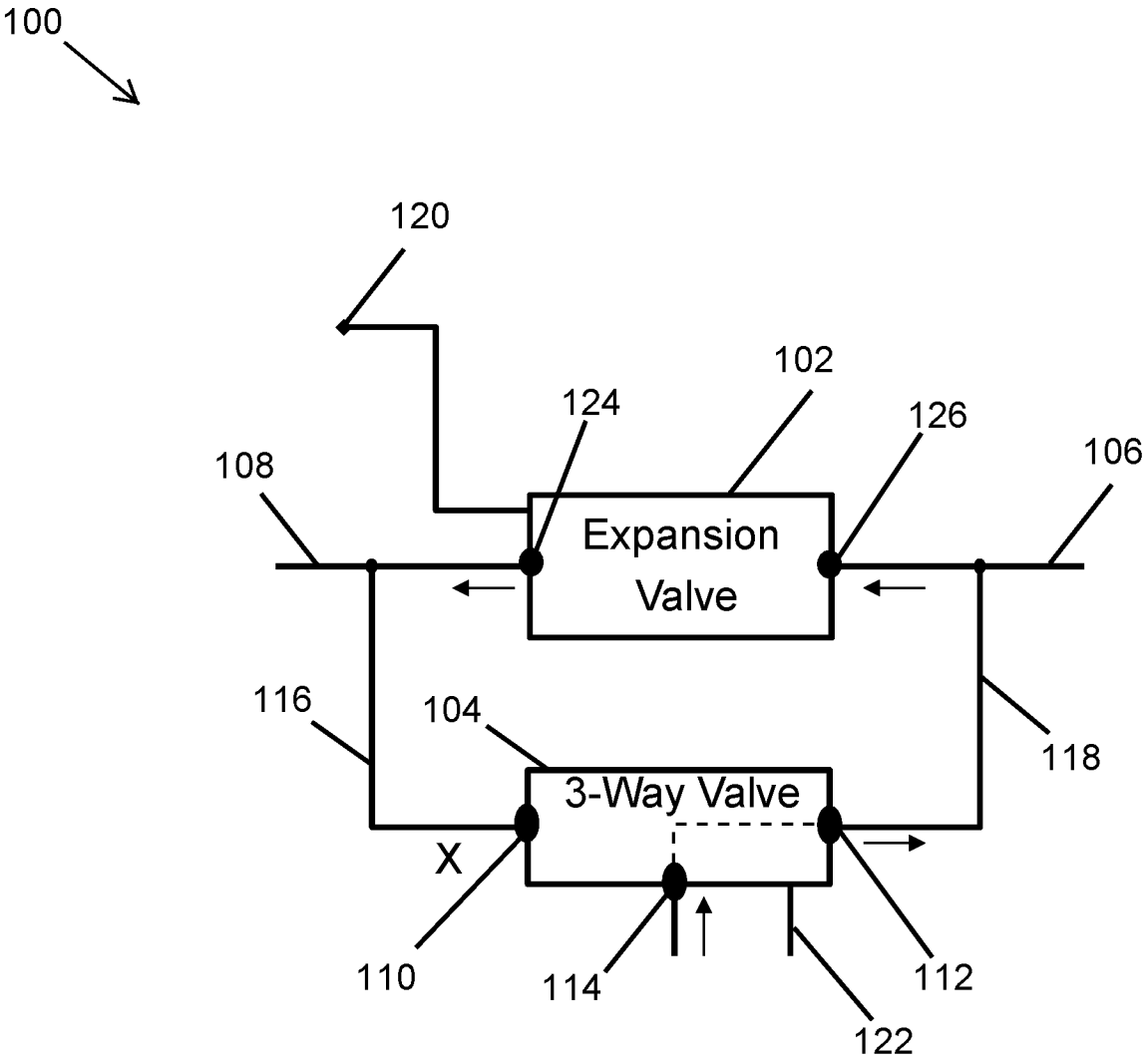
FIG. 1 illustrates a pressure spike prevention assembly configured for a defrost mode operation of a heat pump system according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings may designate like or corresponding, but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

In some example embodiments, a 3-way solenoid type valve that operates in conjunction with the reversing valve of a heat pump system may be used to force liquid refrigerant that is displaced from the charge compensator back into the refrigerant line of the system upstream of the metering device when the system operating mode changes from heating to defrost (which is the same as cooling mode). The use of the 3-way solenoid type valve enables the metering device to control the amount of liquid refrigerant from the charge compensator, and thus can prevent large amounts of liquid refrigerant from flowing to the indoor coil during defrost mode.

Turning now to the figures, particular example embodiments are described. FIG. 1 illustrates a pressure spike prevention assembly 100 configured for a defrost mode operation of a heat pump system according to an example embodiment. In some example embodiments, the pressure spike prevention assembly 100 includes a thermal expansion valve 102 and a multi-way valve 104. The thermal expansion valve 102 controls the amount of liquid refrigerant that passes through the thermal expansion valve 102 to an evaporator coil. For example, the thermal expansion valve 102 may be a bidirectional flow thermal expansion valve that includes a first port 124 and a second port 126 that may each extend into and/or outside of the cavity of the thermal expansion valve 102. The thermal expansion valve 102 may provide a first flow path for a refrigerant to flow from the first port 124 to the second port 126 in one mode of operation and a second flow path for a refrigerant to flow from the second port 126 to the first port 124 in another mode of operation. For example, the thermal expansion valve 102 may control the amount of liquid refrigerant that passes from the second port 126 to the first port 124.

In some example embodiments, the multi-way valve 104 may be a 3-way valve. For example, the multi-way valve 104 may be a 3-way solenoid valve. For example, the multi-way valve 104 may include an inlet port 110, an outlet port 112, and a liquid line port 114 that may each extend into and/or outside of the cavity of the multi-way valve 104. The first port 110 may be designed to be fluidly coupled to an indoor coil of a heat pump system. The second port 112 may be designed to be fluidly coupled to an outdoor coil of a heat pump system. The liquid line port 114 may be designed to be fluidly coupled to a charge compensator of a heat pump system. In FIG. 1, the arrows adjacent to the ports indicate direction of refrigerant flow and, X shows a closed port or flow path.

In some example embodiments, the first port 124 of the thermal expansion valve 102 may be in fluid communication with the inlet port 110 of the multi-way valve 104. To illustrate, a refrigerant pipe 108 may be connected to the first port 124 of the thermal expansion valve 102, and a refrigerant pipe 116 that is connected to the inlet port 110 of the multi-way valve 104 at one end may be connected to the pipe 108.

In some example embodiments, the second port 126 of the thermal expansion valve 102 may be in fluid communication with the outlet port 112 of the multi-way valve 104. To illustrate, a refrigerant pipe 106 may be connected to the second port 126 of the thermal expansion valve 102. A refrigerant pipe 118 that is connected to the outlet port 112 of the multi-way valve 104 may be connected to the pipe 106.

In some example embodiments, the multi-way valve 104 is configured as shown in FIG. 1 for operations in a defrost mode of a heat pump system. When the multi-way valve 104 is configured for a defrost mode operation, the multi-way valve 104 may provide a flow path for liquid refrigerant to flow from the liquid line port 114 to the outlet port 112, and the inlet port 110 may be closed such that the refrigerant flowing out of the thermal expansion valve 102 through the first port 124 does not flow into the multi-way valve 104.

When the pressure spike prevention assembly 100 is configured for the defrost mode operation as shown in FIG. 1, the outlet port 112 is open such that liquid refrigerant that flows into the multi-way valve 104 through the liquid line port 114 is directed to the thermal expansion valve 102 through the outlet port 112 and the pipes 118, 106. Such a configuration of the multi-way valve 104 allows liquid refrigerant to enter the refrigerant pipe 106 upstream of the thermal expansion valve 102 during a defrost mode operation. During defrost mode operations of a heat pump system that includes the pressure spike prevention assembly 100, such a configuration enables the thermal expansion valve 102 to control the flow of liquid refrigerant to an evaporator/indoor coil that is downstream of the thermal expansion valve 102. For example, the thermal expansion valve 102 may control the flow of liquid refrigerant through the thermal expansion valve 102 based on superheat sensing by a sensing bulb 120 as can be readily understood by those of ordinary skill in the art with the benefit of this disclosure.

In some example embodiments, the configuration of the pressure spike prevention assembly 100 shown in FIG. 1 may be the same in both defrost and cooling operations of a heat pump system. In some example embodiments, the multi-way valve 104 may be configured such that inlet port 110 is closed, and the outlet port 112 and the liquid line port 114 are open as shown in FIG. 1, when a heat pump system that includes the pressure spike prevention assembly 100 switches from a heating mode to a defrost mode. For example, a valve control electrical signal may be provided to the multi-way valve 104 via an electrical connection 122 that may be connected to a control unit of a heat pump system. To illustrate, the control unit may control change in the configuration of the multi-way valve 104 between the defrost mode configuration shown in FIG. 1 and the heating mode configuration shown in FIG. 2.

By providing a mechanism that allows the thermal expansion valve 102 to control the flow of liquid refrigerant from a charge compensator to an evaporator/indoor coil, the pressure spike prevention assembly 100 can prevent pressure spikes in a heat pump and avoid system shutdown. As described below, the pressure spike prevention assembly 100 can prevent pressure spikes during defrost mode operations without disrupting system refrigerant flow during heating mode operations.

In some example embodiments, the pressure spike prevention assembly 100 may be included in a packaged heat pump system. In some alternative embodiments, the thermal expansion valve 102 and the multi-way valve 104 may be fluidly coupled using a different configuration of refrigerant pipes than shown in FIG. 1 without departing from the scope of this disclosure. In some alternative embodiments, a multi-way valve other than a 3-port valve may be used instead of the multi-way valve 104 without departing from the scope of this disclosure. In some example embodiments, the multi-way valve 104 may direct refrigerant between different ports of the multi-way valve 104 without closing or opening the external opening of the ports. For example, the multi-way valve 104 may direct the flow of refrigerant within the multi-way valve 104. In some alternative embodiments, the thermal expansion valve 102 and the multi-way valve 104 may be made as a single device without departing from the scope of this disclosure.

Figure 2:
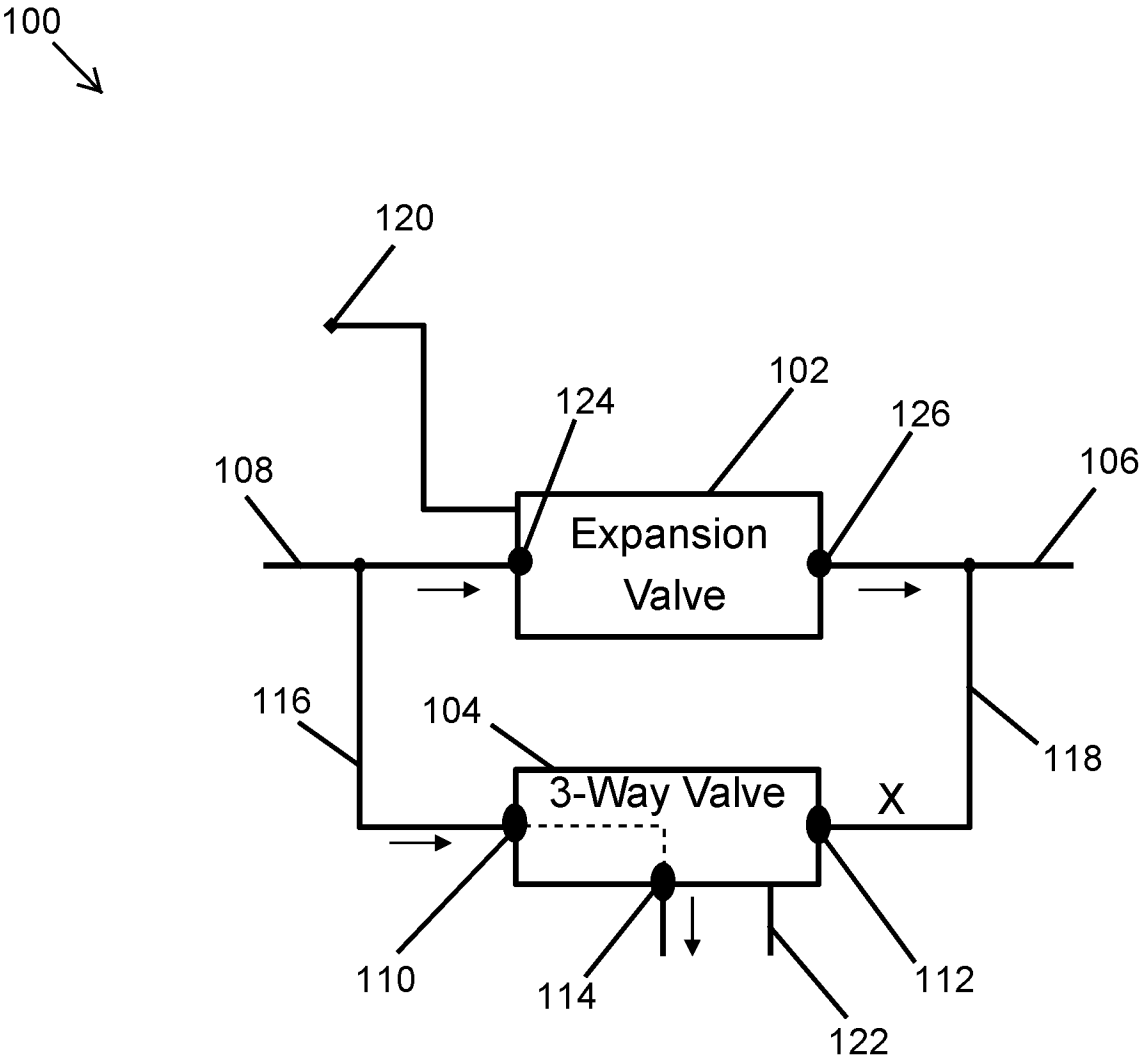
FIG. 2 illustrates the pressure spike prevention assembly of FIG. 1 configured for a heating mode operation of a heat pump system according to an example embodiment.

FIG. 2 illustrates the pressure spike prevention assembly 100 of FIG. 1 configured for a heating mode operation of a heat pump system according to an example embodiment. In FIG. 2, the arrows adjacent to the ports indicate direction of refrigerant flow and, X indicates a closed port or flow path. Referring to FIGS. 1 and 2, in contrast to the defrost mode configuration of the pressure spike prevention assembly 100 shown in FIG. 1, in FIG. 2, the inlet port 110 of the multi-way valve 104 is open, and the outlet port 112 of the multi-way valve 104 is closed. Because the outlet port 112 is closed in FIG. 2, refrigerant that enters the multi-way valve 104 through the inlet port 110 is prevented from flowing out through the outlet port 112. Because the liquid line port 114 is open, the multi-way valve 104 provides a flow path for refrigerant to flow from the inlet port 110 of the multi-way valve 104 to the liquid line port 114 of the multi-way valve 104. That is, refrigerant that enters the multi-way valve 104 through the inlet port 110 flows out of the multi-way valve 104 through the liquid line port 114, which may be fluidly coupled to a charge compensator when the pressure spike prevention assembly 100 is integrated in a heat pump system.

In some example embodiments, when the pressure spike prevention assembly 100 is included in a heat pump system, the pipe 108 may be fluidly coupled to an indoor coil, and the pipe 106 may be fluidly coupled to an outdoor coil. In the configuration of the pressure spike prevention assembly 100 shown in FIG. 2, the thermal expansion valve 102 provides a flow path between the first port 124 of the thermal expansion valve 102 and the second port 126 of the thermal expansion valve 102 for refrigerant to flow through the thermal expansion valve 102 from the pipe 108 to the pipe 106.

In some example embodiments, the refrigerant pipe 116 is fluidly coupled to the refrigerant pipe 108 such that some of the refrigerant in the pipe 108 can be diverted through the multi-way valve 104 to a charge compensator, for example, until the charge compensator is full. Such a configuration of the multi-way valve 104 allows a charge compensator of heat pump system to operate as intended by holding some of the system refrigerant during heating mode operations.

By allowing a flow of refrigerant through the thermal expansion valve 102 and some refrigerant to flow through the multi-way valve 104 during heating mode operations, the pressure spike prevention assembly 100 allows normal heating mode operations of a heat pump system while preventing pressure spikes during defrost mode operations as described with respect to FIG. 1.

Figure 3:
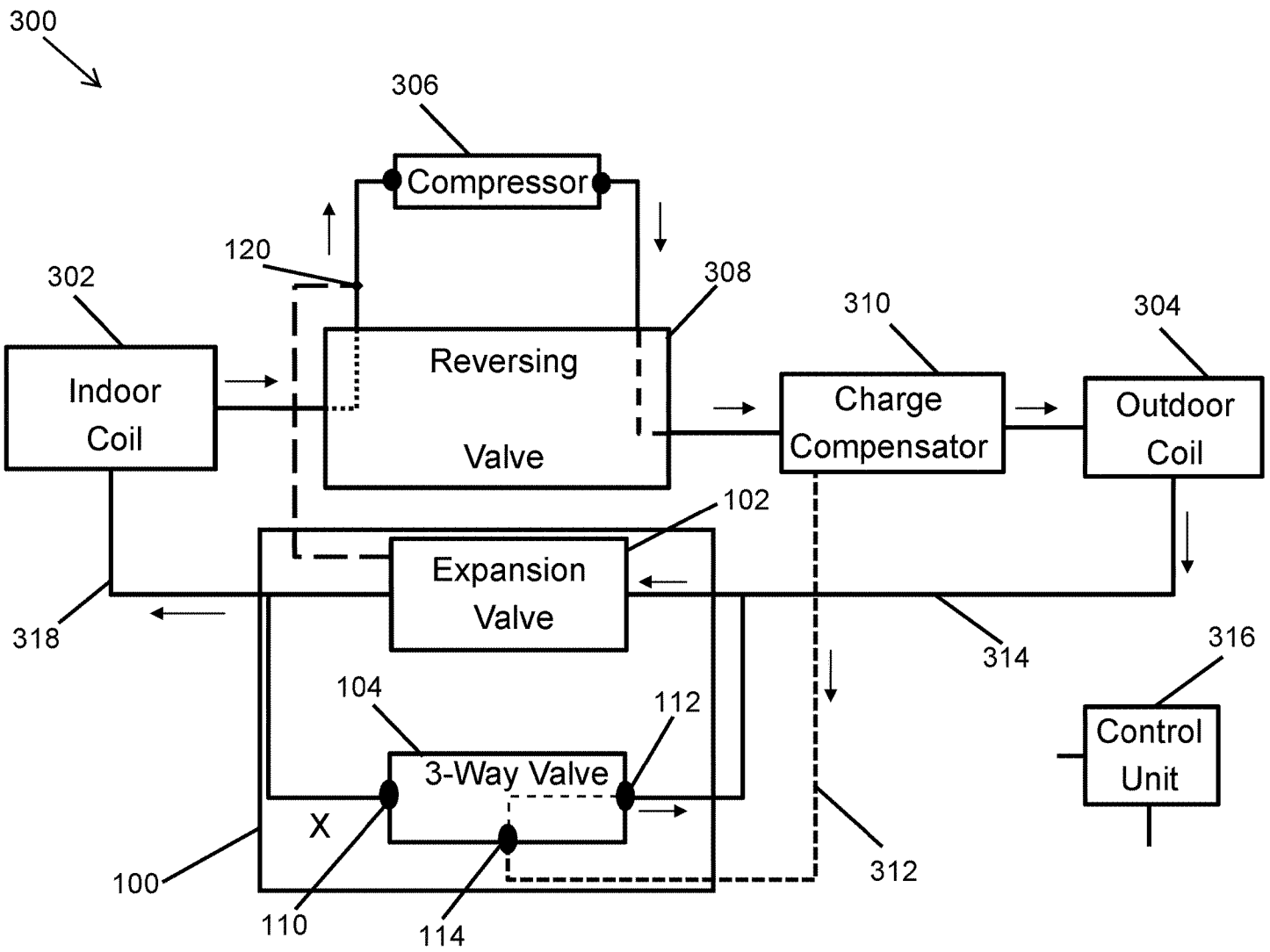
FIG. 3 illustrates a heat pump system configured for a defrost mode operation according to an example embodiment.

FIG. 3 illustrates a heat pump system 300 configured for a defrost mode operation according to an example embodiment. In FIG. 3, the arrows related to the components of the heat pump system 300 indicate direction of refrigerant flow and, X indicates a closed port or flow path. Referring to FIGS. 1 and 3, in some example embodiments, the heat pump system 300 includes the pressure spike prevention assembly 100 of FIG. 1, where the pressure spike prevention assembly 100 is configured for defrost mode operation. The heat pump system 300 also includes an indoor coil 302 and an outdoor coil 304. For example, the indoor coil 302 and the outdoor coil 304 may be low capacity coils, such as microchannel coils.

In some example embodiments, the heat pump system 300 may also include a compressor 306, a reversing valve 308, and a charge compensator 310. In the defrost mode configuration of the heat pump system 300 shown in FIG. 3, the reversing valve 308 may be configured such that refrigerant flows from the indoor coil 302 to the suction port of the compressor 306 through the reversing valve 308 and such that the refrigerant flows from the discharge port of the compressor 306 to the charge compensator 310 through the reversing valve 308. The charge compensator 310 is fluidly coupled to the outdoor coil 304 such that the refrigerant from the compressor 306 flows to the outdoor coil 308 through the reversing valve 308 and the charge compensator 310.

In some example embodiments, the charge compensator 310 is fluidly coupled to the multi-way valve 104 such that refrigerant that accumulated in the charge compensator 310 flows to the multi-way valve 104. For example, the liquid line port of the charge compensator 310 may be fluidly coupled to the liquid line port 114 of the multi-way valve 104 via the liquid line 312, and refrigerant may flow from the charge compensator 310 to the multi-way valve 104 via the liquid line 312. To illustrate, refrigerant may accumulate in the charge compensator 310 during heating mode operations of the heat pump system 300, and the accumulated liquid refrigerant may flow out of the charge compensator 310 during defrost mode operations. Because the multi-way valve 104 provides a flow path from the liquid line port 114 to the outlet port 112, the refrigerant that flows from the charge compensator 310 to the multi-way valve 104 through the liquid line port 114 flows out of the multi-way valve 104 through the outlet port 112. The refrigerant that flows out through the outlet port 112 flows into the thermal expansion valve 102 via the second port 126 of the thermal expansion valve 102.

In some example embodiments, the thermal expansion valve 102 is in fluid communication with the indoor coil 302 via a refrigerant pipe 318 that is downstream from the thermal expansion valve 102 based on the direction of refrigerant flow during the defrost mode operation of the heat pump system 300. The thermal expansion valve 102 is also in fluid communication with the outdoor coil 304 via a refrigerant pipe 314 that is upstream from thermal expansion valve 102. To illustrate, refrigerant from the outdoor coil 304 flows into the thermal expansion valve 102 via the second port 126 of the thermal expansion valve 102.

The thermal expansion valve 102 controls the flow of refrigerant from the outdoor coil 304 to the indoor coil 302 through the thermal expansion valve 102. The thermal expansion valve 102 also controls the flow of refrigerant from the charge compensator 310 to the indoor coil 302 through multi-way valve 104 and the thermal expansion valve 102. Because the inlet port 110 of the multi-way valve 104 is closed in the defrost mode configuration of the pressure spike prevention assembly 100, the refrigerant that flows out of the thermal expansion valve 102 flows to the indoor coil 302 without disruption by the multi-way valve 104. The thermal expansion valve 102 may adjust the refrigerant flow from the outdoor coil 304 and the charge compensator 310 to the indoor coil 302 based on superheat sensing, for example, by the sensing bulb 120.

In some example embodiments, a control unit 316 may control changes in the configuration of the heat pump system 300 between heating mode and defrost/cooling mode. For example, the control unit 316 may provide one or more electrical signals to the multi-way valve 104 and the reversing valve 308 to change the configurations of the multi-way valve 104 and the reversing valve 308. By changing the configurations of the multi-way valve 104 and the reversing valve 308, the control unit 316 may control the directions of refrigerant flow in the heat pump system 300. The control unit 316 may control the configuration changes based on indications from one or more thermostats as can be readily understood by those of ordinary skill in the art with the benefit of this disclosure. In some example embodiments, the control unit 316 may include a controller and components, such as a microcontroller and other supporting components (e.g., a memory device), to perform the operations of the control unit 316 described herein.

By routing the refrigerant from the charge compensator 310 to the upstream side of the thermal expansion valve 102 through the multi-way valve 104, the pressure spike prevention assembly 100 enables the thermal expansion valve 102 to control the flow of refrigerant from the charge compensator 310 to the indoor coil 302. Because the superheat in the suction line to the compressor 306 is dependent on the amount of refrigerant that flows through the thermal expansion valve 102 and because the refrigerant from the charge compensator 310 is routed through the thermal expansion valve 102 along with the refrigerant from the outdoor coil 304, the multi-way valve 104 enables the thermal expansion valve 102 to avoid pressure spikes that may otherwise result in the compressor 306 being shut down.

The same configuration of the heat pump system 300 shown in FIG. 3 used in cooling mode and defrost mode operations. In some example embodiments, the heat pump system 300 may include more or fewer components than shown without departing from the scope of this disclosure. In some alternative embodiments, some of the components of the heat pump system 300 may be fluidly coupled in a different manner than shown in FIG. 3 without departing from the scope of this disclosure.

Figure 4:
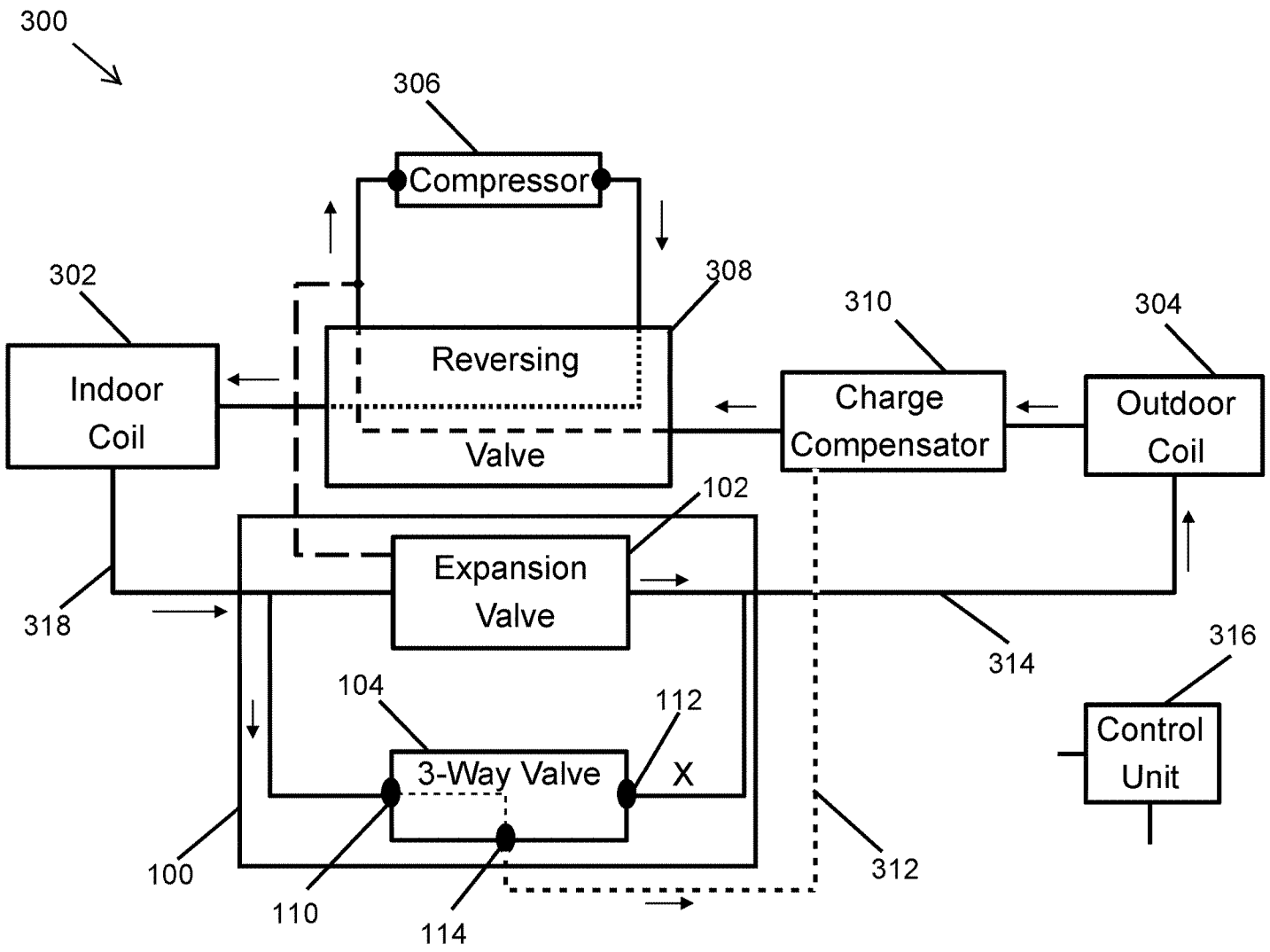
FIG. 4 illustrates the heat pump system of FIG. 3 configured for a heating mode operation according to an example embodiment.

FIG. 4 illustrates the heat pump system 300 of FIG. 3 configured for a heating mode operation according to an example embodiment. In FIG. 4, the arrows related to the components of the heat pump system 300 indicate direction of refrigerant flow and, X indicates a closed port or flow path. In FIG. 4, the heat pump system 300 includes the pressure spike prevention assembly 100 of FIG. 2 configured for a heating mode operation. In contrast to FIG. 3, in FIG. 4, the reversing valve 308 is configured such that refrigerant flows from the charge compensator 310 to the suction port of the compressor 306 through the reversing valve 308. The reversing valve 308 is also configured such that refrigerant flows from the discharge port of the compressor 306 to the indoor coil 302 through the reversing valve 308. The configuration of the reversing valve 308 provides a flow path for refrigerant to flow from the outdoor coil 304 to the indoor coil 302 through the charge compensator 310 and the reversing valve 308.

In FIG. 4, the pressure spike prevention assembly 100 is configured such that refrigerant flows from the indoor coil 302 back to the outdoor coil 304 through the thermal expansion valve 102. Some refrigerant also flows from the indoor coil 302 to the charge compensator 310 through the multi-way valve 104, for example, up to the capacity of the charge compensator 310. To illustrate, the multi-way valve 104 provides a flow path for some of the refrigerant flowing from the indoor coil 302 to flow to the charge compensator 310 through the multi-way valve 104. For example, the refrigerant that flows into the multi-way valve 104 via the inlet port 110 flows out through the liquid line port 114 and travels to the charge compensator 310 via the pipe 312. As explained above with respect to FIG. 2, the outlet port 112 is closed when the pressure spike prevention assembly 100 is configured to operate in heating mode as shown in FIGS. 2 and 4.

By allowing the refrigerant from the indoor coil 302 to flow through the thermal expansion valve 102 to the outdoor coil 304 and by allowing some refrigerant to flow to the charge compensator 310 through the multi-way valve 104, the pressure spike prevention assembly 100 enables the heat pump system 300 to operate in normal heating mode.

Figure 5:
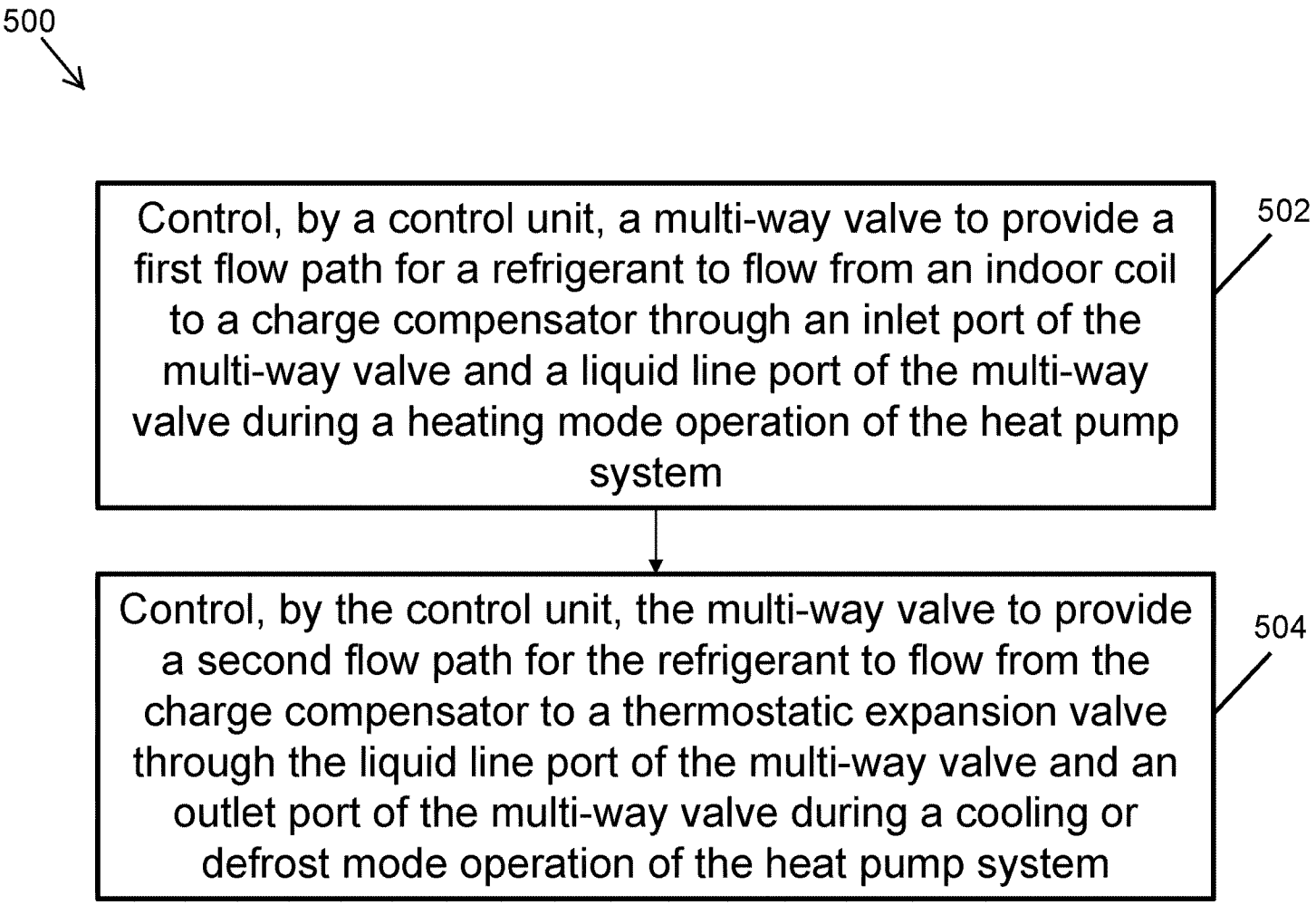
FIG. 5 illustrates a method of operating a heat pump system that includes a pressure spike prevention assembly according to an example embodiment.

FIG. 5 illustrates a method 500 of operating the heat pump system 300 that includes a pressure spike prevention assembly 100 of FIGS. 1 and 2 according to an example embodiment. Referring to FIGS. 1-5, in some example embodiments, the method 500 includes, at step 502, controlling, by the control unit 316, the multi-way valve 104 to provide a first flow path for a refrigerant to flow from the indoor coil 302 to the charge compensator 310 through the inlet port 110 of the multi-way valve 104 and the liquid line port 114 of the multi-way valve 104 during a heating mode operation of the heat pump system 300.

At step 504, the method 500 may include controlling, by the control unit 316, the multi-way valve 104 to provide a second flow path for the refrigerant to flow from the charge compensator 310 to the thermostatic expansion valve 102 through the liquid line port 114 of the multi-way valve 104 and the outlet port 112 of the multi-way valve 104 during a cooling or defrost mode operation of the heat pump system 300.

In some example embodiments, the method 500 may include controlling, by the control unit 316, the reversing valve 308 such that a discharge port of the compressor 306 is fluidly coupled to the charge compensator 310 through the reversing valve 308 during the cooling or defrost mode operation of the heat pump system 300. To illustrate, during the cooling or defrost mode operation of the heat pump system 300, the refrigerant from the discharge port of the compressor 306 flows to the charge compensator 310 through the reversing valve 308.

In some example embodiments, the method 500 may also include controlling, by the control unit 316, the reversing valve 308 such that the discharge port of the compressor 306 is fluidly coupled to the indoor coil 302 through the reversing valve 308 during the heating mode operation of the heat pump system 300. To illustrate, during the heating mode operation of the heat pump system 300, the refrigerant from the discharge port of the compressor 306 flows to the indoor coil flows through the reversing valve 308.

In some alternative embodiments, the method 500 may include more or fewer steps than described above. In some example embodiments, some of the steps of the method 500 may be performed in a different order than described above.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A pressure spike prevention assembly for use in a heat pump system, the pressure spike prevention assembly comprising:

a thermostatic expansion valve comprising a first port and a second port, wherein the first port is designed to be fluidly coupled to an indoor coil and wherein the second port is designed to be fluidly coupled to an outdoor coil; and a multi-way valve comprising an inlet port, an outlet port, and a liquid line port, wherein the inlet port is fluidly coupled to the first port, wherein the outlet port is fluidly in communication with the second port, and wherein the liquid line port is configured to be fluidly coupled to a charge compensator of the heat pump system via a liquid line of the heat pump system.

2. The pressure spike prevention assembly of claim 1, wherein, during a heating mode operation of the heat pump, the inlet port is open and the outlet port is closed.

3. The pressure spike prevention assembly of claim 2, wherein, during the heating mode operation of the heat pump system, the multi-way valve provides a refrigerant flow path from the inlet port to the liquid line port.

4. The pressure spike prevention assembly of claim 1, wherein, during a defrost mode of the heat pump system, the inlet port is closed and the outlet port is open.

5. The pressure spike prevention assembly of claim 4, wherein, during the defrost mode of the heat pump system, the multi-way valve provides a refrigerant flow path from the liquid line port to the outlet port.

6. The pressure spike prevention assembly of claim 1, wherein, during a defrost mode operation, the thermostatic expansion valve provides a flow path through the thermostatic expansion valve from the second port to the first port.

7. The pressure spike prevention assembly of claim 1, wherein, during a heating mode operation, the thermostatic expansion valve provides a flow path through the thermostatic expansion valve from the first port to the second port.

8. A heat pump system, comprising:

a charge compensator;

a thermostatic expansion valve comprising a first port and a second port; and a multi-way valve comprising an inlet port, an outlet port, and a liquid line port, wherein the inlet port is fluidly coupled to the first port, wherein the outlet port is fluidly in communication with the second port, and wherein the liquid line port is fluidly coupled to the charge compensator via a liquid line of the heat pump system.

9. The heat pump system of claim 8, wherein the inlet port is open and the outlet port is closed during a heating mode operation of the heat pump system and wherein the inlet port is closed and the outlet port is open during a defrost mode of the heat pump system.

10. The heat pump system of claim 8, wherein, during a defrost mode operation of the heat pump system, the multi-way valve provides a refrigerant flow path from the charge compensator to the thermostatic expansion valve through the liquid line port and the outlet port.

11. The heat pump system of claim 8, further comprising an indoor coil, wherein the inlet port and the first port are fluidly coupled to the indoor coil.

12. The heat pump system of claim 11, wherein, during a heating mode operation of the heat pump system, the multi-way valve provides a refrigerant flow path from the indoor coil to the charge compensator through the inlet port and the liquid line port.

13. The heat pump system of claim 11, further comprising an outdoor coil, wherein the outlet port and the second port are fluidly coupled to the outdoor coil.

14. The heat pump system of claim 13, wherein, during a heating mode operation, a system refrigerant flows from the indoor coil to the outdoor coil through the thermostatic expansion valve.

15. The heat pump system of claim 13, wherein, during a defrost mode operation, a system refrigerant flows from the outdoor coil to the indoor coil through the thermostatic expansion valve.

16. The heat pump system of claim 8, further comprising a compressor and a reversing valve, wherein a discharge port of the compressor is fluidly coupled to the charge compensator through the reversing valve during a defrost mode operation of the heat pump system and wherein a suction port of the compressor is fluidly coupled to the charge compensator through the reversing valve during a heating mode operation of the heat pump system.

17. The heat pump system of claim 16, further comprising a control unit that controls operations of the reversing valve and the multi-way valve.

18. A method of operating a heat pump system that includes a pressure spike prevention assembly, the method comprising:

controlling, by a control unit, a multi-way valve to provide a first flow path for a refrigerant to flow from an indoor coil to a charge compensator through an inlet port of the multi-way valve and a liquid line port of the multi-way valve during a heating mode operation of the heat pump system; and controlling, by the control unit, the multi-way valve to provide a second flow path for the refrigerant to flow from the charge compensator to a thermostatic expansion valve through the liquid line port of the multi-way valve and an outlet port of the multi-way valve during a cooling or defrost mode operation of the heat pump system.

19. The method of claim 18, further comprising controlling, by the control unit, a reversing valve such that a discharge port of a compressor is fluidly coupled to the charge compensator through the reversing valve during the cooling or defrost mode operation of the heat pump system.

20. The method of claim 18, wherein the inlet port is fluidly coupled to a first port of the thermostatic expansion valve, wherein the outlet port is fluidly coupled to a second port of the thermostatic expansion valve, and wherein the liquid line port is fluidly coupled to the charge compensator via a liquid line of the heat pump system.

* * * * *